United States Patent [19]

Ortiz Bordallo

[11] Patent Number: 5,002,425

[45] Date of Patent: Mar. 26, 1991

[54] FLOORING AND/OR TILING WITH GOLDEN ARABESQUE DESIGNS

[76] Inventor: Antonio J. Ortiz Bordallo, Magallanes, 1, Madrid, Spain

[21] Appl. No.: 337,882

[22] Filed: Apr. 14, 1989

[51] Int. Cl.[5] ..... E01C 5/00

[52] U.S. Cl. ..... 404/42; 52/314; 52/315; 52/390

[58] Field of Search ..... 52/311, 314, 315, 390; 404/42

[56] References Cited

U.S. PATENT DOCUMENTS

| | | | |
|---|---|---|---|
| 250,456 | 12/1881 | Sellers | 404/42 |
| 455,095 | 6/1891 | Cameron | 52/314 |
| 1,838,108 | 9/1926 | Rhodes | 52/311 |
| 3,017,724 | 7/1958 | Frank | 52/311 |
| 4,133,152 | 1/1979 | Penrose | 404/40 |
| 4,651,993 | 3/1987 | Netsch, Jr. | 52/311 |

FOREIGN PATENT DOCUMENTS

| | | | |
|---|---|---|---|
| 188079 | 12/1956 | Austria | 52/311 |
| 117121 | 6/1926 | Fed. Rep. of Germany | 52/315 |
| 366662 | 1/1939 | Italy | 404/42 |
| 475623 | 3/1952 | Italy | 52/315 |
| 5579 | of 1885 | United Kingdom | 51/315 |

*Primary Examiner*—Ramon S. Britts
*Assistant Examiner*—Roger J. Schoeppel
*Attorney, Agent, or Firm*—Wenderoth, Lind & Ponack

[57] ABSTRACT

Flooring and/or tiling with golden arabesque designs is configurated by three square pieces with sides ( $$\frac{\text{"}a\sqrt{2}\text{"}}{2},$$

)

which are able to function through any combination of one, two or three pieces. The first of these pieces has one of its diagonal lines with a length of "a". The second square bears an identical representation of its diagonal, and a parallel tracing to the diagonal at a distance from a vertex closest thereto of ( $$\frac{\text{"}a(3-2\sqrt{2})\text{"}}{2},$$

)

while the third piece has both diagonals measuring "a" illustrated thereon, and several tracings parallel to one of its diagonals, at a distance of ( $$\frac{\text{"}a(3-2\sqrt{2})\text{"}}{2},$$

)

"a" being any real number.

4 Claims, 2 Drawing Sheets

FLOORING AND/OR TILING WITH GOLDEN ARABESQUE DESIGNS

BACKGROUND OF THE INVENTION

The present invention relates to flooring and/or tiling with golden arabesque designs which contributes several extremely important advantages to be found in the materials used in construction. The invention is effected through any type of material, like siliceous clay, soil used in landscaping, wood, slate, etc., with designs of perimeters treated on the basis of colors contrasting with the general coloring of the piece. This color may be any one color found within the spectrum of colors, whether the same as or different from the general coloring of the piece.

At present, and in reference to the status of previous techniques, there is no type of flooring, paving tiles or tiles similar to the invention. At the present time, all are painted in various colors or are contrasted by the use of difference types of material.

SUMMARY OF THE INVENTION

First is defined what constitutes a flooring with golden arabesque designs. Golden arabesque designs are used for either flooring or tiling, and are structured by the division of arcs in a golden rectangle, formed by the side of any square and its diagonal.

The flooring according to the present invention is composed of three basic pieces. The first piece is a square having sides with a magnitude of $$\frac{\text{"}a\sqrt{2}\text{"}}{2},$$

where "a" is any real number. One of its diagonal lines is drawn on the square.

The second piece is also a square having sides with a magnitude of $$\frac{\text{"}a\sqrt{2}\text{"}}{2},$$

where "a" may be any real number and where a drawing of one of its diagonals will be made as well as a parallel tracing drawn at a position spaced from a vertex closest thereto a magnitude of $$\frac{\text{"}a(3-2\sqrt{2})\text{"}}{2}.$$

The third piece is composed, like the previous pieces, by a square surface having sides equal to a magnitude of $$\frac{\text{"}a\sqrt{2}\text{"}}{2}.$$

A drawing on this square includes both diagonal lines and two tracings parallel one of the diagonals and separated therefrom at a distance of $$\frac{\text{"}a(3-2\sqrt{2})\text{"}}{2}$$

on each side of the diagonal.

BRIEF DESCRIPTION OF THE DRAWINGS

Further objects, features and advantages of the present invention will become apparent from the following detailed description of the invention, taken in conjunction with the accompanying drawings, wherein.

DETAILED DESCRIPTION OF THE PREFERRED EMBODIMENT

Figure 1:
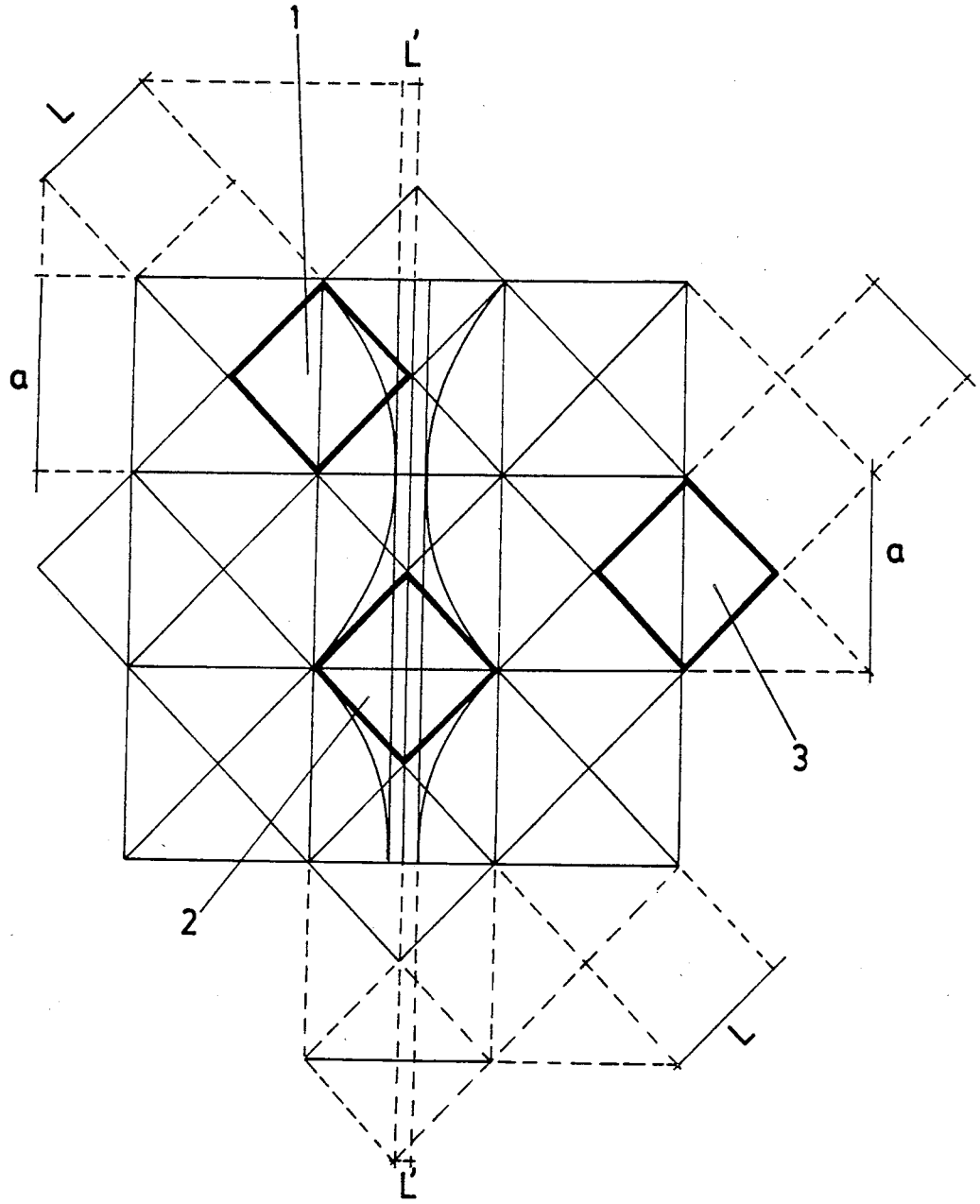
FIG. 1 illustrates three tiling pieces for flooring or tiling.

In FIG. 1, the development of three pieces constituting the present invention is represented. These three pieces are obtained starting with a horizontal square having a magnitude of sides equal to "a", "a" being any real number. On this square, diagonals having a magnitude of "$a\sqrt{2}$" are drawn, so that, as one can observe in FIG. 1, three squares, 1, 2 and 3 according to the invention are obtained, set vertically, with the dimensions of their sides being equal to half of the diagonal of the horizontal square. Therefore, this dimension will be $$\frac{\text{"}a\sqrt{2}\text{"}}{2}$$

for the sides of each of the three squares, its magnitude being denoted as "L".

In the first square, denoted here by the reference number 3, one of its diagonals is drawn. An identical diagonal is drawn for the second square, defined in FIG. 1 as number 1. A parallel tracing is drawn at a distance equal to that obtained when drawing a golden rectangle, placed at a distance of "a ($\sqrt{2}$-1)" from the diagonal or at a distance of $$\frac{\text{"}a(3-2\sqrt{2})\text{"}}{2}$$

from the closest vertex i.e. the vertex adjacent the parallel line.

The third square, identified in the figure as number 2, has both its diagonals drawn and has two parallel tracings parallel to one of the diagonals, spaced therefrom a distance of $$\frac{\text{"}a(3-2\sqrt{2})\text{"}}{2}$$

and obtained as observed in FIG. 1 by means of tracing the golden rectangle.

Figure 2:
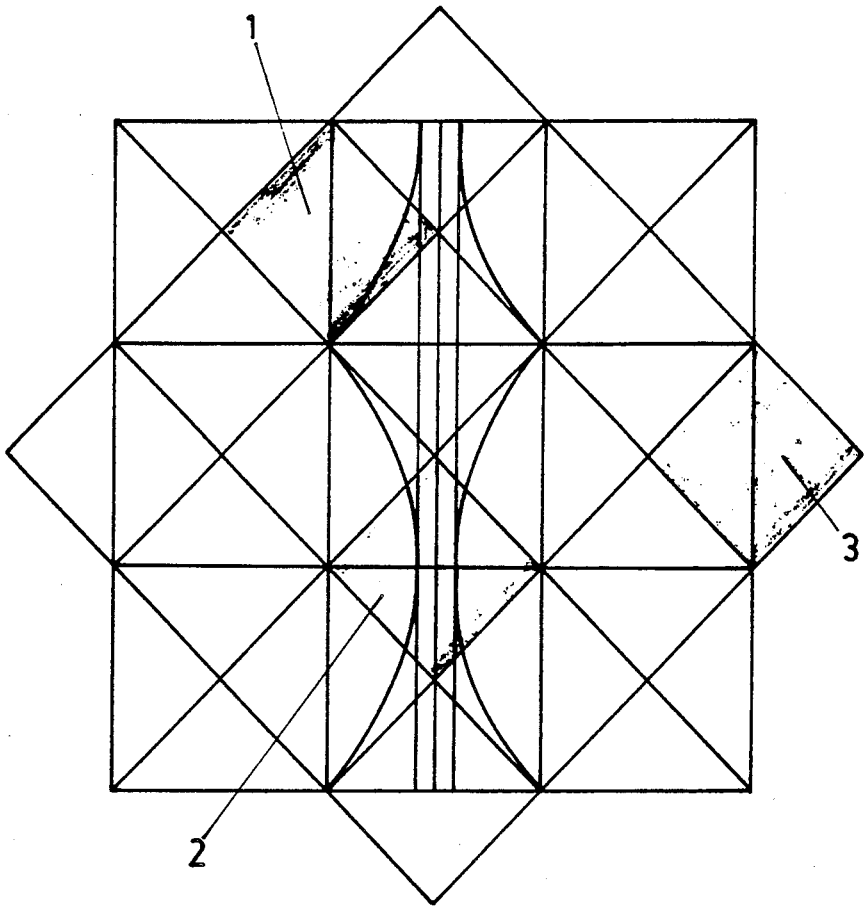
FIG. 2 one of multiple applications achievable with configurations of the three tiling pieces of FIG. 1.

FIG. 2 represents one of multiple applications achievable with the elements of this invention, showing, by means of a dark background, elements 1, 2 and 3, the only three pieces which form part of the flooring or tiling which are part of the present invention. It should be pointed out that the number of combinations that may be obtained from these three pieces is quite high, due to the multiple dispositions which can be obtained.

The material which makes up the flooring or tiling may be of any type, such as siliceous clay, landscape soil, wood, slate, etc., with designs and perimeters which are treated on a color base different from those of the piece. This coloring can be any one color within the total spectrum of colors. It may be different or the same as the general coloring of the piece. One or more clefts made on these pieces will be well formed in the same or a different color to that of the general color of the piece or any other color which is being handled and which can trace this geometrical design.

The coloring will be any color within the spectrum of colors, or an industrial color, or any other known type of color, as long as its texture is flat, corrugated or of any other type such as those which are frequently used.

I claim:

1. A tiling arrangement for golden arabesque designs, said tiling arrangement comprised of a plurality of tiling pieces, said plurality of tiling pieces comprising:

a first tiling piece shaped in the form of a first square, each side of said first square having a magnitude of $$\frac{a\sqrt{2}}{2},$$

wherein 'a' is an real number;

a second tiling piece shaped in the form of a second square, each side of said second square having a magnitude of $$\frac{a\sqrt{2}}{2};$$

and a third tiling piece shaped in the form of a third square, each side of said third square having a magnitude of $$\frac{a\sqrt{2}}{2}$$

, wherein 'a' is any constant for each of said first, second and third tiling pieces such that each of said squares have sides of the same magnitude;

wherein said first tiling piece has one of its diagonals drawn thereon, said diagonal having a magnitude of 'a';

wherein said second tiling piece has one of its diagonals drawn thereon, and further has a parallel line thereon parallel to and spaced from said diagonal a magnitude '$a(\sqrt{2}-1)$' and spaced from a vertex closest thereto a magnitude $$\frac{a(3-2\sqrt{2})}{2};$$

;

and wherein said third tiling piece has both its diagonals drawn thereon, each said diagonal having a magnitude of 'a', and two lines parallel to one of said diagonals drawn thereon, both said lines being spaced from said diagonal a magnitude of $$\frac{a(3-2\sqrt{2})}{2}.$$

2. The tiling arrangement as set forth in claim 1, wherein:

said parallel line of said second tiling piece is uninterrupted and extends completely across said second tiling piece from one side thereof to another.

3. The tiling arrangement as set forth in claim 1, wherein:

both said parallel lines of said third tiling piece extend completely across said third tiling piece from one respective side thereof to another respective side thereof.

4. The tiling arrangement as set forth in claim 1, wherein:

said parallel line of said second tiling piece is uninterrupted and extends completely across said second tiling piece from one side thereof to another; and both said parallel lines of said third tiling piece extend completely across said third tiling piece from one respective side thereof to another respective side thereof.

* * * * *